US006910357B2

(12) United States Patent
Hirvi

(10) Patent No.: US 6,910,357 B2
(45) Date of Patent: Jun. 28, 2005

(54) TAMPER PROOF LOCKING DEVICE

(75) Inventor: Jorma Hirvi, Ärla (SE)

(73) Assignee: Ab Fas Lasfabrik, Eskilstuna (SE)

( * ) Notice: Subject to any disclaimer, the term of this patent is extended or adjusted under 35 U.S.C. 154(b) by 0 days.

(21) Appl. No.: 10/638,311

(22) Filed: Aug. 12, 2003

(65) Prior Publication Data

US 2004/0035159 A1 Feb. 26, 2004

Related U.S. Application Data

(63) Continuation of application No. 09/786,881, filed as application No. PCT/SE99/01580 on Sep. 10, 1999, now abandoned.

(30) Foreign Application Priority Data

Sep. 10, 1998 (SE) ..... 9803073

(51) Int. Cl.[7] ..... E05B 15/16; E05B 63/00
(52) U.S. Cl. ..... 70/422; 70/416
(58) Field of Search ..... 292/1, 25, 51, 292/96, 144, 138, 337, 346, 36, 33; 70/416, 422

(56) References Cited

U.S. PATENT DOCUMENTS

| | | | |
|---|---|---|---|
| 567,290 | A | 9/1896 | Bruns |
| 3,603,632 | A | 9/1971 | Grass |
| 3,695,068 | A | 10/1972 | Eads et al. |
| 3,811,717 | A | 5/1974 | Floyd et al. |
| 4,143,528 | A | 3/1979 | Weber et al. |
| 4,183,565 | A | 1/1980 | Allemann |
| 4,218,903 | A | 8/1980 | Eads |
| 4,413,493 | A | 11/1983 | Meinsen et al. |
| 4,559,795 | A | 12/1985 | Zagoroff |
| 4,706,577 | A | 11/1987 | Jones |
| 4,773,240 | A | 9/1988 | Foshee |
| 4,799,718 | A | 1/1989 | Ing |
| 4,958,508 | A | 9/1990 | Lin |
| 5,009,089 | A | 4/1991 | Lin |
| 5,104,164 | A | 4/1992 | Sieg |
| 5,784,973 | A | 7/1998 | Mercer et al. |
| 5,813,709 | A | 9/1998 | Umino |
| 6,152,498 | A | 11/2000 | Lindqvist |

FOREIGN PATENT DOCUMENTS

| | | |
|---|---|---|
| CH | 676730 A5 | 2/1991 |
| DE | 36 06 719 | 9/1987 |
| DE | 196 13 865 | 10/1997 |
| EP | 0 433 623 | 10/1990 |
| EP | 0 290 348 | 11/1998 |
| GB | 2101667 A | 1/1983 |

*Primary Examiner*—John B. Walsh
(74) *Attorney, Agent, or Firm*—Sughrue Mion, PLLC

(57) ABSTRACT

A lock includes a lock housing (3), a bolt (20) which is moveable in the lock housing between an inwardly withdrawn and an outwardly extended position and which includes a weakened region (36). The lock also includes a blocking element (5) fixedly arranged in the lock housing, an interlocking device (12, 14, 16), and a bolt-carried abutment element (34) which is adapted to coact with the interlocking device (16). When the bolt is subjected to an outer force that exceeds a generally predetermined force, the bolt will deform in the weakened region (36) so that movement of the bolt between the outwardly extended and inwardly withdrawn positions will be blocked by the fixedly mounted blocking element (5).

5 Claims, 3 Drawing Sheets

TAMPER PROOF LOCKING DEVICE

This is a continuation of application Ser. No. 09/786,881 filed Mar. 9, 2001 now abandoned, which is a National Stage Application filed under §371 of PCT Application No. PCT/SE99/01580 filed Sep. 10, 1999; the above noted prior applications are all hereby incorporated by reference.

FIELD OF INVENTION

The present invention relates to a lock and more specifically to a lock which includes a bolt or catch that is self-locking when subjected to force.

BACKGROUND OF THE INVENTION

A known problem in this field is that the bolts of locks can be subjected to heavy forces in an attempt to force or break open a locked door. These forces may be generated by heavy blows with a hammer-like tool or may be generated with the aid of a crowbar or like tool. The object is to destroy the latching function of the lock, so as to enable the bolt or latch to be moved to an inward, non-locking position and therewith allow the door to be opened. Because the interlocking pin or like member takes-up a large part of the force exerted, the pin must be dimensioned to absorb these forces, which is difficult to achieve. Otherwise, a weak lock construction must be accepted.

The European Patent Specification EP-A1-0 290 348 describes a lock bolt which can be blocked in an outwardly extended, locking position when subjected to violence from outside the lock. The lock mechanism includes a moveable element which in an outwardly extended position engages a weakened region in the bolt and therewith causes permanent deformation of the bolt when subjected to heavy forces from outside the lock. The bolt is not in itself self-locking, and the moveable element is required in order to achieve permanent locking of the lock.

OBJECT OF THE INVENTION

The object of the present invention is to provide a lock bolt which is self-locking when subjected to heavy forces from outside the lock.

SUMMARY OF THE INVENTION

This object is achieved with a lock that includes a lock housing, a lock bolt which is mounted in said housing for movement between an inwardly withdrawn position and an outwardly extended position and which includes a weakened region, said lock being characterised by a locking element fixedly mounted in the lock housing, a moveably arranged interlocking element, and a bolt-mounted abutment element which is adapted to coact with the interlocking element in an interlocking position so that when that part of the bolt exposed outside the lock housing is subjected to an external force which exceeds a predetermined force, the bolt will be deformed at said weakened region so that movement of said bolt between said outwardly extended and inwardly withdrawn positions will be blocked by said fixedly mounted blocking element.

There is also provided a lock bolt which is characterised by a weakened region and an abutment element which is adapted to coact with an interlocking element in said lock such that if the bolt is subjected to an external force that exceeds a predetermined magnitude the bolt will be deformed in said weakened region so that movement of the bolt between said outwardly extended and inwardly withdrawn positions will be blocked by a blocking element fixedly mounted in the lock. Further proposed embodiments will be evident from the depending Claims.

BRIEF DESCRIPTION OF THE DRAWINGS

The invention will now be described in more detail with reference to exemplifying embodiments thereof and also with reference to the accompanying drawings, in which.

DESCRIPTION OF EMBODIMENTS

Figure 2:
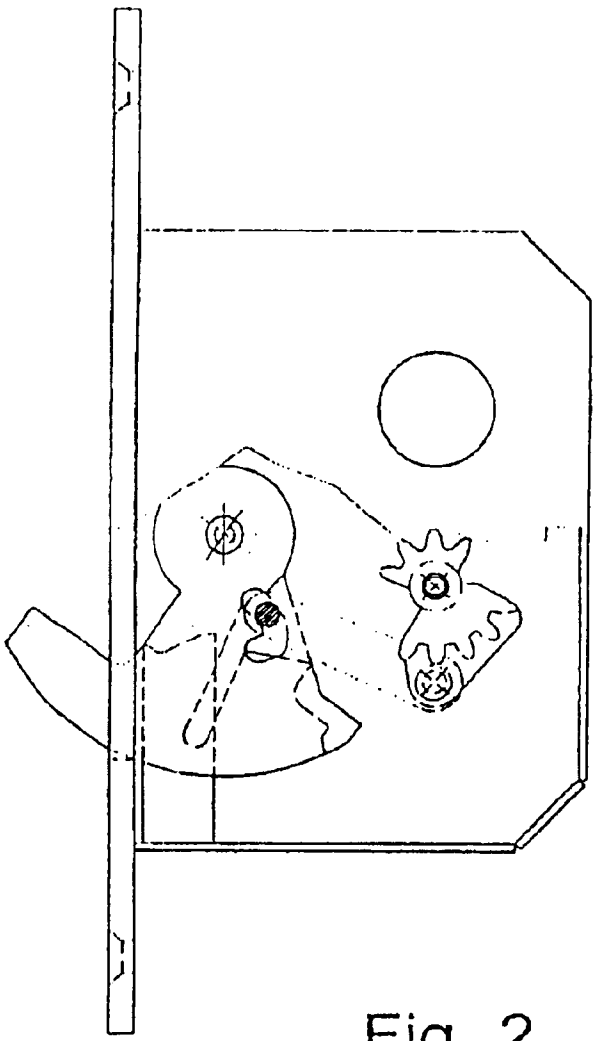
FIG. 2 shows the lock of FIG. 1 with the bolt in a position between its inwardly withdrawn and outwardly extended positions.

Preferred embodiments of the invention will now be described. The lock, generally referenced 1, comprises a housing 3, a lock post 5 integral with the housing, a lock pack (not shown), an interlocking unit generally referenced 10, and a lock bolt 20.

The interlocking unit is mounted between the lock pack and the bolt and includes a gear ring 12 which actuates an arm 14 when caused to rotate. The arm carries at one end a pin 16 which runs in a track (not shown) in the housing 3 from a first end position, shown in FIG. 1 to a second end position, shown in FIGS. 3 and 4.

The bolt 20 is a pivotal bolt and is mounted for pivotal movement about a point 22. The bolt is comprised of three lamellae, two outer lamellae 26 and 28 and an intermediate lamella or deformation lamella 24. The lamellae have essentially the same external shape so as to form a pack which is held together by rivets (not shown). The outer lamellae include a channel 30 in which the pin 16 runs as the bolt 20 is moved between its inward and outward positions. The channels 30 are shown in full lines in the Figures.

The intermediate lamella 24, however, includes a channel 32 whose shape differs from the shape of the channel 30 in the outer lamellae, said channel 32 being shown in broken lines in the Figure. More specifically, the channel 32 in the intermediate lamella presents an abutment surface 34 to the pin 16 and provides a weakened region 36 in the form of a waist. The function of these will be made more apparent in the following description with reference to the drawings.

Figure 1:
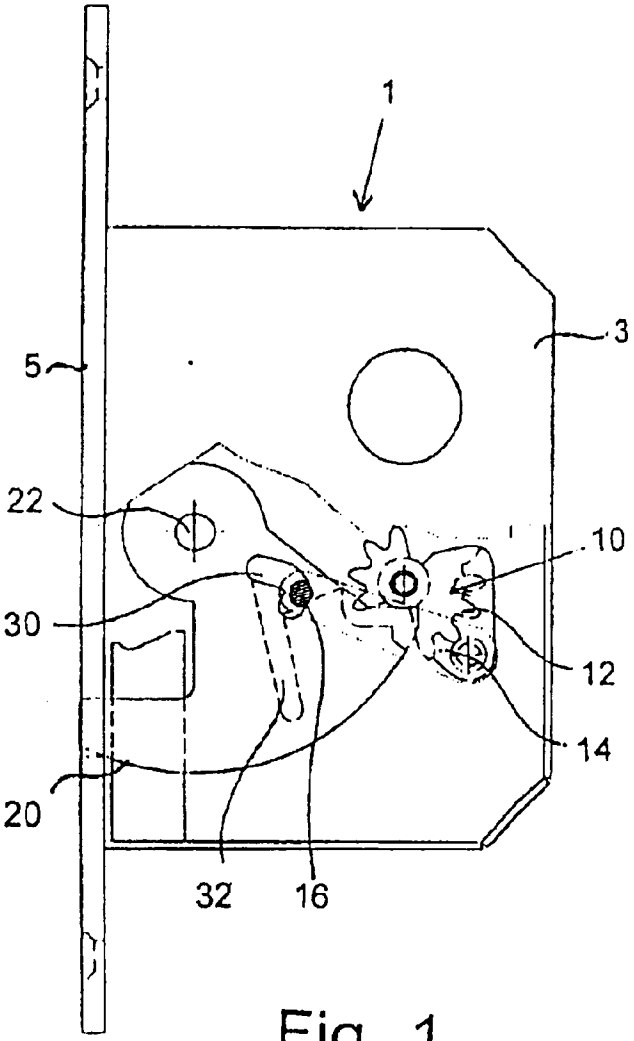
FIG. 1 is a partially cut-away side view of an inventive lock with the bolt inwardly withdrawn.
Figure 5:
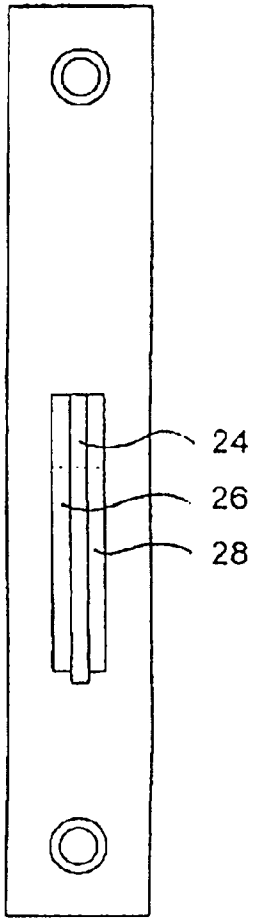
FIG. 5 is an end view of the lock shown in FIG. 4.
Figure 3:
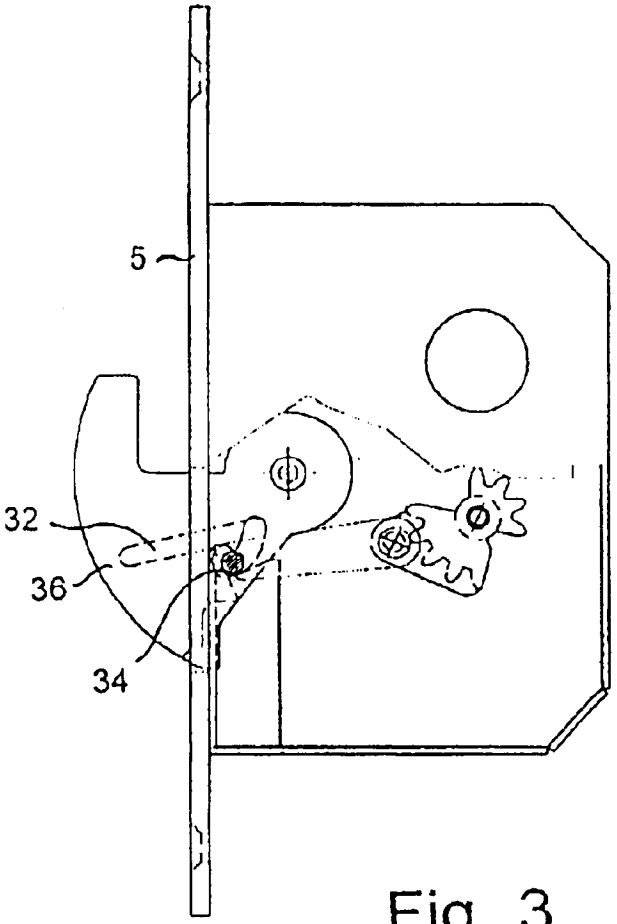
FIG. 3 shows the lock of FIG. 1 with the bolt in an outwardly extended position.

FIG. 1 shows a lock starting position with the bolt 20 in an inwardly withdrawn non-locking position. When a key (not shown) is turned in the lock pack, the gear ring 12 is caused to rotate and therewith move the arm 14 and the pin 16 to the left in the Figures. The pin 16 runs in tracks in the walls of the housing 3 and presses against the abutment surface 34 on the intermediate lamella, thereby urging the bolt 20 out from its inwardly withdrawn position, see FIG. 1, to an outwardly extended position, which is shown in FIG. 3 and which corresponds to a locking position, via the position shown in FIG. 2. The intermediate lamella is constructed so as to withstand with a given margin those forces that normally occur on the abutment surface when moving the bolt to its locking position, without deforming said intermediate lamella.

Figure 4:
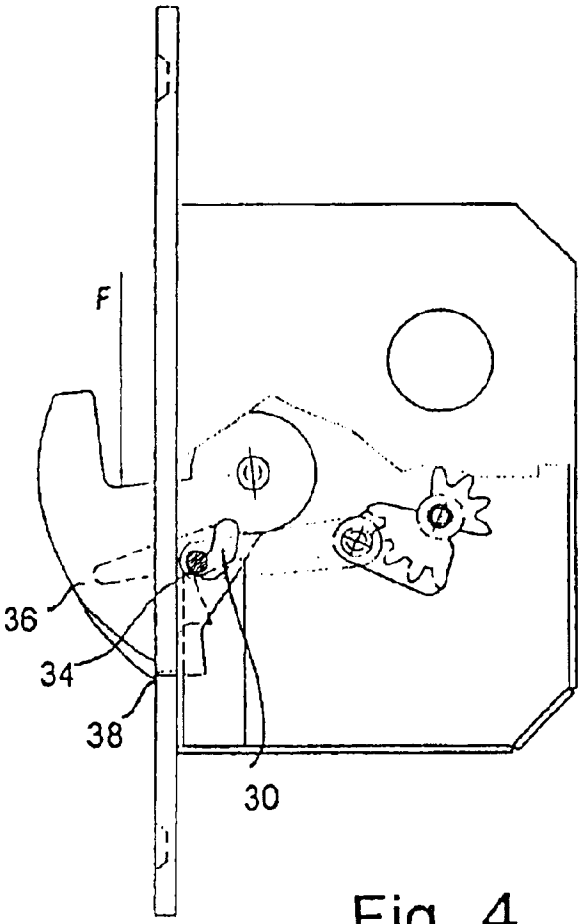
FIG. 4 shows the lock of FIG. 1 with the bolt in an outwardly extended position, subsequent to said deformation.

If the bolt 20 is subjected to an external force that strives to return the bolt to its inwardly withdrawn, non-locking position, as indicated in FIG. 4 by a downwardly acting force F, part of this force will increase the pressure at which the pin 16 bears on the abutment surface 34, so as to deform said intermediate lamella in the manner illustrated in broken lines in FIG. 4. The weakened region 36 of the deformation lamella therewith functions as a "hinge", so that the lower part of the deformation lamella will be pressed obliquely downwards in FIG. 4, in comparison with the remaining lamellae. The deformation lamella 24 is deformed during this application of the external force F, until the pin 16 reaches the end of the tracks 30 in the external lamellae 26, 28. At the same time, part of the deformation lamella 52 will have been pressed outwards so as to cause lamella material to lie in abutment with the lock post material, see the area marked 38 in FIG. 4. This will then prevent the bolt from being pushed into the lock without first deforming the material in the lock post. Since the lock post is one of the strongest parts of the lock construction, it would require an extremely large force F to deform the post. Practical tests have shown that a force corresponding to more than 2,000 kilograms would be required to effect such deformation.

This construction provides a lock bolt which can be produced just as easily and just as cheaply as a typical bolt but which will nevertheless withstand forces that greatly exceed those forces which a conventional lock construction is able to withstand. This is achieved because the bolt is constructed to be deformed when subjected to heavy external-forces, so that part of the bolt material will cause the bolt to be locked in its outwardly extending locking position. One advantage afforded in this respect is that no devices in addition to those normally found in conventional locks of the aforedescribed kind are required, that is other than the inventive lock bolt itself. Neither is the manufacture of the actual lock bolt more expensive or more complicated than the manufacture of conventional bolts, since the various lamellae are cut out in the same way as conventional bolts.

The only requirement with respect to the pin 16 is that it will deform the deformation lamella without breaking. When the deformation lamella has deformed, the forces are taken up by the lock post.

Figure 8:
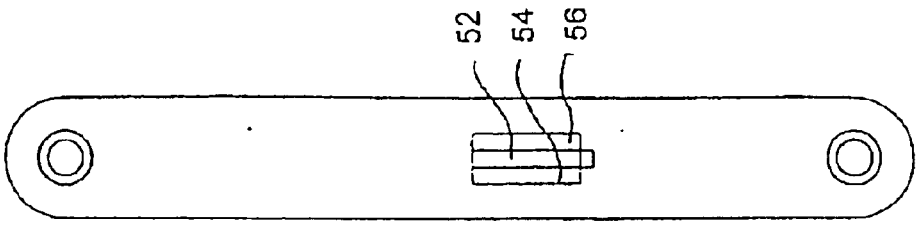
FIG. 8 is an end view of the lock shown in FIG. 7.

An alternative embodiment of an inventive lock will now be described with reference to FIGS. 6–8. This embodiment differs generally from the aforedescribed embodiment by virtue of the bolt being a linear movement bolt or push bolt.

Figure 6:
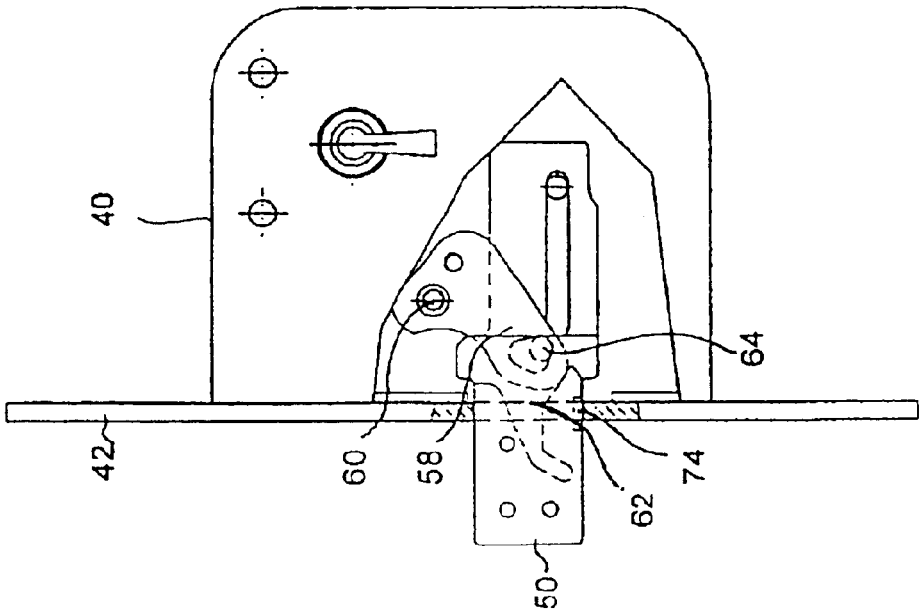
FIG. 6 illustrates an alternative embodiment of a lock according to the invention.

FIG. 6 shows the lock prior to deformation of the bolt. The lock comprises two main parts: a housing or box 40 and a lock post 42 integral with said housing. The lock housing 40 houses a push bolt 50 which is mounted for linear movement between an inwardly withdrawn position and an outwardly extending position, of which the latter is shown in the Figures. The push bolt 50 is comprised of a deformation lamella 52 sandwiched between two outer lamella 54, 56, see FIG. 8. The lock also includes an interlocking element 58 which is mounted for pivotal movement about a point 60. The interlocking element 58 causes the bolt 50 to move between its two outer positions when pivoted.

Figure 7:
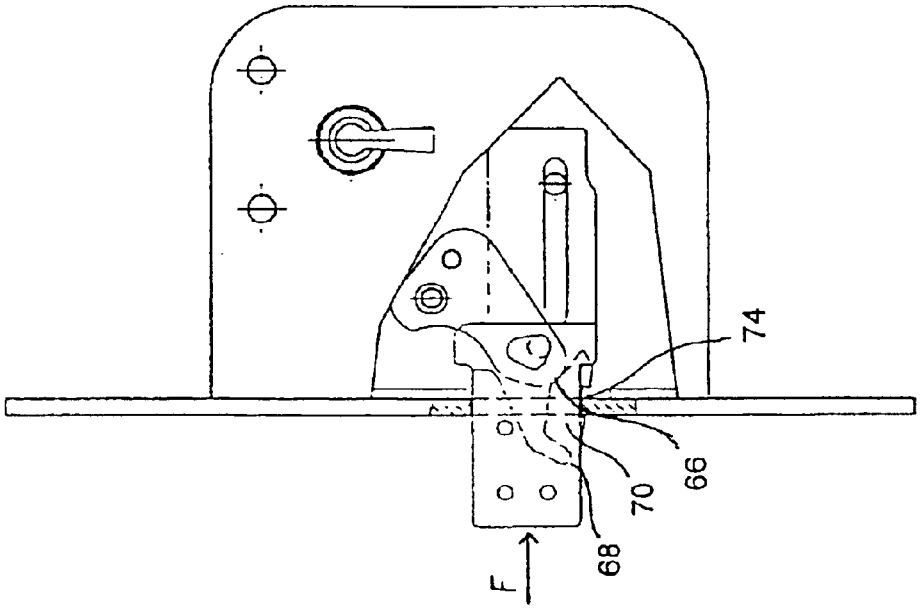
FIG. 7 shows the lock of FIG. 6 subsequent to deformation of the bolt.

FIGS. 6 and 7 show how the bolt of this embodiment of the invention is constructed and deformed when subjected to a heavy external force, referenced F in FIG. 7. The intermediate deformation lamella 52 includes a notch 62 with which the interlocking element 58 engages whilst, at the same time, coacting with a pin 64 arranged on the bolt. When the force F is applied, the bolt will be forced inwards from its outwardly extended position and therewith cause an engagement point 66 to press against the interlocking element. The deformation lamella 52 is consequently deformed about a weakened region 68 and therewith provide a hinge effect.

In this deformation process, the lower part 70 of the deformation lamella of said bolt is bent downwards, see FIG. 7. This brings a notch or recess 74 in the lower part of the deformation lamella 52 into engagement the bottom edge of the bolt receiving opening in the lock post 42. The lock post 42 therewith blocks movement of the bolt inwards into the lock, i.e. to the right in FIGS. 6 and 7. There is thus achieved an effect which corresponds to the effect achieved with the first embodiment, i.e. there is obtained a lock construction with which extremely large forces are required in order to force the bolt into the lock housing.

According to the invention, the deformation lamella is dimensioned so that it will not be deformed in normal use, there being afforded a wide margin in this respect.

Although the invention has been described with reference to bolt embodiments that include three lamellae, an intermediate deformation lamella and two outer lamellae, it will be understood that the number of lamellae may be varied. For instance, the deformation lamella can be divided into two lamellae, therewith obtaining a total of four lamellae. An inventive bolt can also be constructed without lamellae, provided that the desired deformation can be achieved.

The outer lamellae may consist of hardened material. The deformation lamellae, however, will preferably not be made of hardened material, since it will not then have the desired deformation properties. This does not present a problem, however, since it is only the outer lamellae that are accessible to anyone wishing to force the lock.

In the illustrated embodiments, the lock post functions as blocking means for the deformed lock bolt. By way of an alternative, an element in the form of a shoulder or the like firmly anchored in the lock housing may also function as a blocking means. One alternative is to fit through the lock housing a through-penetrating pin which functions to block movement of the bolt. Because the pin or the like is firmly anchored, the same mechanical strength is achieved as that achieved with the illustrated embodiments.

I claim:

1. A lock, comprising:

a lock housing (3; 40);

a bolt or catch (20; 50) mounted in said housing for movement between an inwardly withdrawn position and an outwardly extended position and which includes a weakened region (36; 68);

a blocking element (5; 42) comprising a lock post of the lock housing;

a moveably mounted interlocking device (12, 14, 16; 58); and a bolt-mounted abutment element (34; 66) adapted to coact with the interlocking device in an interlocking position so that when a part of the bolt exposed outside the lock housing, in said outwardly extended position, is subjected to an external force that strives to return the bolt to its inwardly withdrawn position and that exceeds a generally predetermined force, the bolt will deform in said weakened region upon stress in the form of a force caused by the co-action between said abutment element and said interlocking device, wherein the deformed bolt has a shape such that said blocking element blocks movement of the bolt from said outwardly extended position to said inwardly withdrawn position, wherein the bolt (20; 50) is comprised of at least three lamella (24, 26, 28; 52, 54, 56) and the abutment element (34; 66) and the weakened region (36; 68) are arranged on at least one intermediate lamella (24; 52).

2. A lock according to claim 1, wherein the bolt (20) is a pivot bolt.

3. A lock according to claim 1, wherein the bolt (50) is a push bolt.

4. A lock according to claim 1, wherein the weakened region (36; 68) has the form of a waist designed to provide a hinge effect in the event of said deformation.

5. A lock bolt for mounting in a lock housing comprising a lock post, said bolt comprising:

a weakened region (36; 68); and an abutment element (34; 66) adapted to coact with an interlocking device in the lock housing in an interlocking position so that when a part of the bolt exposed outside the lock housing, in said outwardly extended position, is subjected to an external force that strives to return the bolt to its inwardly withdrawn position and that exceeds a generally predetermined force, the bolt will deform in said weakened region upon stress in the form of a force caused by the co-action between said abutment element and said interlocking device, wherein:

the deformed bolt has a shape such that a blocking element comprising said lock post blocks movement of the bolt from said outwardly extended position to said inwardly withdrawn position; and the lock bolt (20; 50) is comprised of at least three lamella (24, 26, 28; 52, 54, 56) and the abutment element (34; 66) and the weakened region (35; 68) are arranged on at least one intermediate lamella (24; 52).

* * * * *